US006354018B1

(12) United States Patent
Swithenbank

(10) Patent No.: US 6,354,018 B1
(45) Date of Patent: Mar. 12, 2002

(54) HEAT AND/OR MASS TRANSFER PROCESSES AND APPARATUS

(75) Inventor: Joshua Swithenbank, Sheffield (GB)

(73) Assignee: University Of Sheffield, Sheffield (GB)

( * ) Notice: Subject to any disclaimer, the term of this patent is extended or adjusted under 35 U.S.C. 154(b) by 0 days.

(21) Appl. No.: 09/297,004

(22) PCT Filed: Oct. 30, 1997

(86) PCT No.: PCT/GB97/02833

§ 371 Date: Jun. 21, 1999

§ 102(e) Date: Jun. 21, 1999

(87) PCT Pub. No.: WO98/19123

PCT Pub. Date: May 7, 1998

(30) Foreign Application Priority Data

Oct. 30, 1996 (GB) ..... 9622558

(51) Int. Cl.[7] ..... F26B 3/08

(52) U.S. Cl. ..... 34/364; 34/366; 34/168; 34/174

(58) Field of Search ..... 34/359, 360, 363, 34/364, 365, 366, 168, 174; 165/104.15, 104.16, 111, 920, DIG. 162

(56) References Cited

U.S. PATENT DOCUMENTS

| | | | | |
|---|---|---|---|---|
| 4,071,960 A | | 2/1978 | Bowles | 24/57 A |
| 4,313,301 A | * | 2/1982 | Belke et al. | 60/39.51 H |
| 4,697,358 A | | 10/1987 | Kitchen | 34/191 |
| 4,699,588 A | * | 10/1987 | Zinn et al. | 432/58 |
| 4,770,626 A | * | 9/1988 | Zinn et al. | 431/1 |
| 4,805,318 A | | 2/1989 | Bramlette et al. | 34/57 |
| 4,909,731 A | * | 3/1990 | Zinn et al. | 432/58 |
| 5,015,171 A | * | 5/1991 | Zinn et al. | 431/1 |
| 5,423,132 A | | 6/1995 | Graber | 34/487 |
| 5,918,569 A | * | 7/1999 | Kudra et al. | 122/4 D |

FOREIGN PATENT DOCUMENTS

| | | | |
|---|---|---|---|
| DE | 512795 C | 11/1930 | |
| EP | 0 625 659 A1 | 11/1994 | F16K/11/074 |
| GB | 1150406 | 4/1969 | F26B/3/10 |
| WO | WO 82/01061 | 4/1982 | F26B/3/10 |

* cited by examiner

*Primary Examiner*—Pamela Wilson
(74) *Attorney, Agent, or Firm*—Fish & Richardson P.C.

(57) ABSTRACT

A heat and/or mass transfer process and apparatus for treating various types of materials. A heat and/or mass transfer process includes causing a gas to impinge upon a flowing material, wherein the gas velocity having a component tangential to the flow direction of the material can be characterized such that a fluctuating velocity is superimposed upon the mean velocity of the material in the flow direction. The process further includes effecting velocity fluctuations by means of a traveling tangential acoustic wave while a steady overall gas flow is maintained, and controlling the gas velocity by means of a vernier valve. By using fluctuating velocity superimposed upon the mean velocity, an effective thermal and mass transfer resistance of the boundary layer can be reduced, as well as reducing the pressure fluctuations.

6 Claims, 1 Drawing Sheet

HEAT AND/OR MASS TRANSFER PROCESSES AND APPARATUS

TECHNICAL FIELD

This invention relates to processes and apparatus concerning heat and/or mass transfer between a gas and a solid or a liquid.

BACKGROUND

Reference will be made hereinbelow to drying processes and apparatus but it is to be understood that the invention has application to other heat and mass transfer processes.

In the treatment of various materials, drying can be an important process, whether it forms the entire process or merely one stage of the treatment. Drying involves the transfer of heat to the material being dried and the transfer of mass (vapour) from the material.

It is known to enhance heat and/or mass transfer processes by the use of standing transverse and longitudinal waves, for example in pulsed columns and in pulsed combustion systems. Such processes are of limited application, however, and often offer little significant advantage. They also frequently give rise to undesirable sound emission.

GB 1150406 describes a fish slurry drying process in which tangentially arranged jet engines inject hot gas in pulses creating a poorly understood flow regime in a drying tank. It is suggested that a net flow of hot gas is subjected to oscillations in each engine exhaust leading to scrubbing of wet particles injected into the exhaust. Flow in the drying tank may involve a series of mutually concentric cyclone-like vortexes alternating upwardly and downwardly in the tank.

SUMMARY

The present invention provides a heat and/or mass transfer process and apparatus wherein the materials to be treated are subjected to a travelling tangential wave during their passage through the apparatus.

According to a first aspect of the invention there is provided a heat and/or mass transfer process in which a gas is caused to impinge upon a material, the gas velocity having a component tangential to the flow direction of the material such that a fluctuating velocity is superimposed upon the mean velocity of the material in the flow direction, said velocity fluctuations being effected by means of a travelling tangential wave whilst a steady overall gas flow is maintained.

In another aspect, the invention provides an apparatus for performing a heat and/or mass transfer process which comprises a chamber within which a material can be located and within which the material can be caused to flow, and means for impinging a gas on the material located within the chamber, the means providing the gas with a velocity having a component tangential to the flow direction of the material in the chamber, such that in use a fluctuating velocity is superimposed upon the mean velocity of the material in the flow direction, and wherein the means for impinging the gas on the material located in the chamber is adapted to create a travelling tangential wave in the material.

By making use of a fluctuating velocity superimposed on the mean velocity, it has been found that the effective thermal and/or mass transfer resistance of the boundary layer can be reduced.

Moreover, by employing a travelling tangential wave there are no pressure fluctuations on the axis and this is preferably where the exhaust for the apparatus is located. In such an apparatus, the emission of sound, which is a problem with pulsating flow devices, can be substantially eliminated.

The invention is preferably applied to drying processes and apparatus, but it is understood that it is not limited thereto and, for example, it may be applied to other heating processes and apparatus, for example heating ovens, and also to mass transfer processes and apparatus, in for example scrubbing towers.

Although the material can be either solid or liquid the invention finds particular application in the treatment of particulate solid materials.

DETAILED DESCRIPTION

Figure 1:
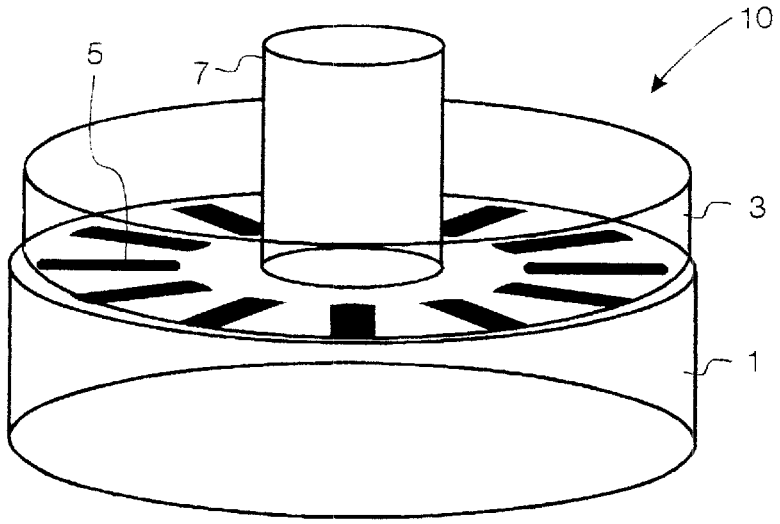
FIG. 1 shows apparatus in accordance with the present invention.

The gas flow may be, for example, a steady gas flow which is fed into a chamber within which the material is located, the entry of the gas into the chamber being controlled by means of a valve or valve system. Preferably a vernier valve arrangement is used, although a fluidic valve system or a jet which rotates at the velocity of the tangential wave could also be used.

Preferably the drying chamber is of cylindrical shape. The general wave equation is:

$$\nabla^2\Phi-\Phi_{tt}=0$$

In cylindrical co-ordinates with appropriate boundary conditions, this has the solution:

$$\Phi(\alpha, \theta, X, Y) = \sum_{n,n_x} (J_n(\alpha)\cos n_x x)(A_1\cos(n\theta + t) + A_2\cos(n\theta - t))$$

where $\Phi$ is the velocity potential. This represents a travelling tangential wave in a cylindrical cavity. The boundary conditions give $\beta$, which is the appropriate zero of $J'_n(\beta)=0$, hence the frequency is given by:

$$f = \frac{c_o}{2}\left\{\left(\frac{\alpha_m}{R}\right)^2 + \left(\frac{n_s}{L}\right)^2\right\}^{1/2}$$

For the first tangential mode the frequency is given by:

$$f = \frac{1.84c_0}{2\pi R}\ \text{Hz}$$

Thus the wave rotates at 1.84 times the speed of sound at the periphery. The pressure, velocity and displacement are given by:

$$\dot{u}=\nabla\Phi$$

$$p = -\gamma\frac{\partial\Phi}{\partial t}$$

$$\text{displacement}=\int_o^t \dot{u}dt$$

For the first harmonic of a pure tangential mode of oscillation in a cylinder, the pressure is distributed as a Bessel function in the radial direction, and as a sine function in the tangential direction. The associated acoustic particle path executes a circle at the centre of the chamber, a curved ellipse at part radius, and a sinusoidal oscillation parallel to the wall in the region adjacent to the wall. The amplitude of the oscillations in velocity (expressed as a dimensionless Mach Number), and the amplitude of the particle displacement (expressed as a dimensionless ratio to the diameter of the cylinder) are related simply to the amplitude of the pressure oscillations (expressed as a dimensionless ratio to the mean chamber pressure) measured at the outer wall. For example, if the amplitude of the wave is 30% of a mean chamber pressure of 1 bar, then the pressure swings from ⅔ bar to ⅓ bar. The corresponding amplitude of the movement of the gas in the chamber is approximately equal to the radius. Assuming a chamber of 1 m diameter with air at ambient temperature, then the frequency of these fluctuations would be 95 Hz. This motion increases the heat and mass transfer in the chamber very significantly, especially as such repeatedly freshly formed boundary layers will be thin.

The travelling tangential wave can be driven to high amplitudes without creating shock waves which quickly limit the amplitude of standing transverse and longitudinal waves. Travelling tangential waves can be driven to very high amplitudes with little input of energy.

An embodiment of the invention will now be described, by way of example only, with reference to the accompanying Drawings.

Apparatus 10, in accordance with the invention, comprises a drying chamber 1 having a relatively small aspect ratio (cylinder length/diameter ratio). In other embodiments of the present invention, the aspect ratio might be greater, for instance, in drying devices such as a semi-dry slurry flue gas scrubber or in a food industry dryer.

Located above drying chamber 1 is an inlet chamber 3 which is in fluid communication with chamber 1 by means of a vernier valve arrangement 5. The apparatus is provided with outlet pipe 7 whereby gas can exit from drying chamber 1. Outlet 7 extends from the top of drying chamber 1 along the longitudinal axis of and through inlet chamber 3. The location of outlet 7 at the pressure node on the axis ensures that there is little loss of acoustic energy through the outlet.

Figure 2:
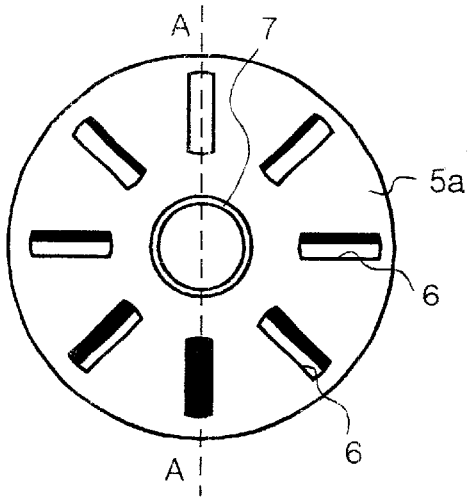
FIG. 2 shows a plan view of the vernier valve of FIG. 1.
Figure 3:
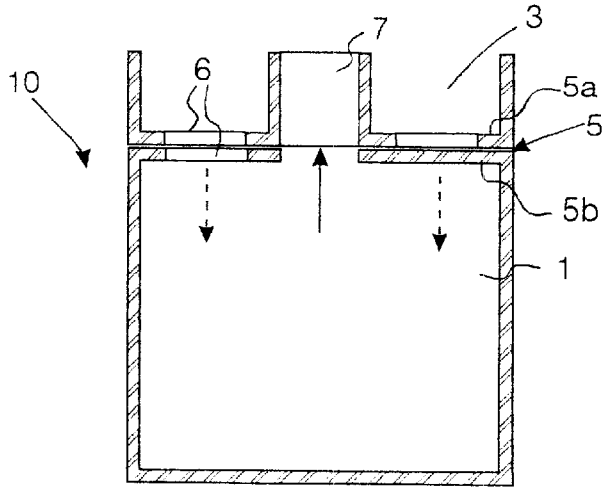
FIG. 3 is a section on the line A—A in FIG. 2.

Vernier valve 5 is a key element in the apparatus since the flow from the inlet chamber 3 must rotate at the speed of the wave in order to drive the wave to high amplitudes. As indicated above, the wave rotates at 1.84 times the speed of sound at the periphery of the chamber. A mechanical valve rotating at this speed would be subject to very high mechanical loads and would also tend to be noisy. The vernier valve solves this problem by using the principle of Moire fringes. The valve consists of two discs 5*a,b* containing N and N+1 holes 6 respectively evenly spaced around the circumference of the valve 5. In FIG. 2, valve plate 5*a* has eight holes 6, while plate 5*b* will have nine or seven. When one disc is rotated slowly with respect to the other, the open area where the holes match each other rotates at N times the speed of the disc. Thus if N=50, the disc can rotate at 1/50 of the wave speed, which is relatively slow.

In the event that drying chamber 1 contains particles which require a very high rate of heat and/or mass transfer, then there exists an optimum size of particle for any given frequency. This arises because the particle motion will tend to lag behind the wave. The maximum relative motion occurs when there is a 90° phase shift between the motion of the gas and the particle. The relative motion of the particle obeys a first order differential equation with a relaxation time given by:

$$\tau_R = \frac{4}{3}\frac{\rho_p d_p^2}{\mu}\frac{1}{C_D Re_p}$$

where the relative Reynolds number of the particle is:

$$Re_p = \frac{d_p \rho |\dot{v}_p - \dot{v}_g|}{\mu}$$

and the drag coefficient $C_D$ is given as a function of Reynolds number.

At very low dimensionless frequencies, the particles tend to follow the gas flow with little slip, whereas at high frequencies they remain almost stationary whilst the gas moves rapidly past them. At the optimum frequency, the out of phase motion of the particle means that the relative motion between the particle and the gas is at a maximum and accordingly the heat and mass transfer is optimum.

In the event that fluidic valves are used to introduce the flow in phase with the wave in the chamber (instead of the vernier valve), they may consist of a set of tuned conventional Coanda switches or vortex amplifiers.

The invention can find application in many areas throughout the process industry. It can, for example, be applied to the treatment of sewage sludge, to the drying of grain, and to the scrubbing of flue gases. Many other applications in the food and process industries will be apparent to those skilled in the art.

What is claimed is:

1. A heat and mass transfer process comprising:

causing a gas to impinge upon a flowing material, the gas velocity having a component tangential to the flow direction of the material characterized in that a fluctuating velocity is superimposed upon the mean velocity of the material in the flow direction;

effecting the velocity fluctuations by means of a traveling tangential acoustic wave whilst a steady overall gas flow is maintained; and, controlling the gas velocity by means of a vernier valve.

2. A process according to claim 1, wherein the heat and mass transfer process is a drying process.

3. A process according to claim 1, wherein the material is a particulate solid material.

4. An apparatus for performing a heat and mass transfer process which comprises a chamber (1) within which a material can be located and within which the material can be caused to flow, and means (3) for impinging a gas on the material located within the chamber, and means (5) for providing the gas with a velocity having a component tangential to the flow direction of the material in the chamber, characterized in that in use, a fluctuating velocity is superimposed upon the mean velocity of the material in the flow direction, and wherein the means for impinging the gas on the material located in the chamber creates, in use, a traveling tangential acoustic wave in the material, wherein the gas flow is controlled by means of a vernier valve.

5. An apparatus according to claim 4, wherein the apparatus comprises a chamber of cylindrical shape.

6. An apparatus according to claim 5, wherein an exhaust (7) for the apparatus is located on the axis of the cylindrical chamber.

* * * * *